US008380094B2

(12) United States Patent
Tomita

(10) Patent No.: US 8,380,094 B2
(45) Date of Patent: Feb. 19, 2013

(54) IMAGE FORMING APPARATUS AND METHOD FOR CALIBRATING TONER IMAGE DETECTION SENSOR

(75) Inventor: Norio Tomita, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 321 days.

(21) Appl. No.: 12/804,817

(22) Filed: Jul. 29, 2010

(65) Prior Publication Data

US 2011/0026953 A1 Feb. 3, 2011

(30) Foreign Application Priority Data

Aug. 3, 2009 (JP) ..... 2009-180925

(51) Int. Cl.
*G03G 15/00* (2006.01)

(52) U.S. Cl. ..... 399/44; 399/49

(58) Field of Classification Search ..... 399/44, 399/49

See application file for complete search history.

(56) References Cited

U.S. PATENT DOCUMENTS

| | | | | |
|---|---|---|---|---|
| 6,321,044 | B1 | 11/2001 | Tanaka | |
| 2004/0042816 | A1 * | 3/2004 | Fukuda et al. | 399/98 |
| 2006/0239705 | A1 * | 10/2006 | Ishibashi | 399/49 |

FOREIGN PATENT DOCUMENTS

| | | | |
|---|---|---|---|
| JP | 2001-100597 | A | 4/2001 |
| JP | 2005-134417 | A | 5/2005 |
| JP | 2007-086439 | A | 4/2007 |
| JP | 2007-121763 | A | 5/2007 |
| JP | 2008-287185 | A | 11/2008 |
| JP | 2009-008839 | A | 1/2009 |

* cited by examiner

*Primary Examiner* — Walter L Lindsay, Jr.
*Assistant Examiner* — Benjamin Schmitt
(74) *Attorney, Agent, or Firm* — Edwards Wildman Palmer LLP; David G. Conlin; David A. Tucker

(57) ABSTRACT

According to an embodiment of the present invention, an image forming apparatus includes a toner image carrier that carries a toner image, a toner image detection sensor that detects a reference toner image on the toner image carrier, a temperature sensor that detects a temperature in the apparatus, and storage section for storing a correlation between each temperature and a drive value for the toner image detection sensor, in which calibration of the toner image detection sensor is performed by acquiring a corresponding drive value from the storage section based on the temperature measured by the temperature sensor and driving the toner image detection sensor at the acquired drive value.

10 Claims, 11 Drawing Sheets

Temperature correction table 106a

| Temperature category | ~10 | 10~30 | 30~50 | 50~ |
|---|---|---|---|---|
| Light emission current valueY(mA) | 2.12 | 2.26 | 2.40 | 2.54 |

IMAGE FORMING APPARATUS AND METHOD FOR CALIBRATING TONER IMAGE DETECTION SENSOR

CROSS-REFERENCE TO RELATED APPLICATIONS

This application claims priority under 35 U.S.C. §119(a) on Patent Application No. 2009-190925 filed in Japan on Aug. 3, 2009, the entire contents of which are herein incorporated by reference.

BACKGROUND OF THE INVENTION

1. Field of the Invention

The present invention relates to an image forming apparatus and more specifically to a method for calibrating a toner image detection sensor that reads the density of a reference toner image formed on a photosensitive drum or an intermediate transfer belt.

2. Related Art

In recent years, electrophotographic image forming apparatuses such as color copiers and color printers that enable multicolor image formation have been developed and, for example, color image forming apparatuses using an intermediate transfer system are well known, in which image formation is performed by forming a toner image of each color on a latent image carrier such as a photosensitive drum, then forming a multicolor image through sequential superimposition and transfer of those toner images of respective colors onto an intermediate transfer belt, which is an intermediate transferer, and then transferring and fixing the multicolor image on recording paper, which is transfer paper.

In such image forming apparatuses, toners are primarily transferred onto an intermediate transfer belt, the densities of the transferred toners are read by an optical sensor (toner image detection sensor) that includes a light emitting device and a light receiving device, and a developing bias is changed according to the toner densities that have been read so as to perform correction such as high density correction and gray-level correction. Registration correction (color shift correction) is also performed in a similar way.

The optical sensor that reads toners transferred on the intermediate transfer belt usually performs its own calibration in order to increase the precision of reading. As a method for performing the calibration, there is a conventional method in which a default value (Yd) for a current value applied to the light emitting device of the optical sensor is stored in advance and used for calibration, as indicated by the dashed-dotted line in FIG. 10. FIG. 10 is an explanatory drawing showing the time required for calibration of the optical sensor in cases where the calibration is performed in a manner according to the present invention (indicated by the solid line) and where the calibration is performed in the conventional manner (indicated by the dashed-dotted line).

Another image forming apparatus has also been suggested, which is configured to, instead of using a default value as described above, correct a reference current value and a reference voltage value by reference to the output of a temperature and humidity sensor and an environmental compensation table so that optimum current and voltage values are output to a transfer roller (see JP 2005-134417A, which is hereinafter referred to as "Patent Document 1").

Ordinarily, optical sensors are highly temperature dependent. However, in the above-described conventional method for performing calibration using a default value (Yd), since no consideration is given to the temperature characteristics of the optical sensor, calibration needs to be retried many times, depending on the ambient temperature (environmental temperature) around the optical sensor at the time of execution of the calibration, and so adjustment of the calibration takes time.

In other words, referring to the conventional calibration example indicated by the dashed-dotted line in FIG. 10, in a case where a sensor output voltage (X11) of the light receiving device acquired by applying a default value (Yd) of current to the light emitting device of the optical sensor deviates from an appropriate value range Xw (e.g., a range of 2.5 to 2.6 V) of the sensor output voltage, calibration for changing the current value applied to the light emitting device by a predetermined value is performed four times in order to make the sensor output voltage within the appropriate value range Xw.

Also, the method described in Patent Document 1 is a method for selecting a correction value from the environmental compensation table, using the correction value to correct the reference current value and the reference voltage value, and outputting the corrected reference current value and the corrected reference voltage value as final values to the transfer roller and a suction roller. That is, while the environmental compensation table is used to correct the reference current value and the reference voltage value, it is not used for the calibration of the optical sensor itself, so that the problem still remains that adjustment of the calibration of the optical sensor takes time as in the case of the conventional technique.

SUMMARY OF THE INVENTION

The present invention has been made in view of the above problems, and it is an object of the invention to provide an image forming apparatus and a method for calibrating a toner image detection sensor, which aim at shortening the time required to perform calibration of an optical sensor itself that reads the density of a reference toner image formed on a photosensitive drum or an intermediate transfer belt.

To solve the aforementioned problems, in the image forming apparatus of the present invention that includes a toner image carrier that carries a toner image, a toner image detection sensor that detects a reference toner image on the toner image carrier, a temperature sensor that detects a temperature in the apparatus, and storage section for storing a correlation between each temperature and a drive value for the toner image detection sensor, calibration of the toner image detection sensor is performed by acquiring a corresponding drive value from the storage section based on the temperature measured by the temperature sensor and driving the toner image detection sensor at the acquired drive value. More specifically, the toner image carrier includes a transfer belt on which a toner image formed on the photosensitive drum is primarily transferred, and the calibration is performed using a basis material of the transfer belt. Preferably, the toner image detection sensor is a reflective optical sensor that includes a light emitting device such as an LED and a light receiving device such as a photodiode.

In other words, the image forming apparatus according to the present invention performs calibration of the toner image detection sensor itself, using a basis material of the transfer belt on which a reference toner image has not been primarily transferred yet, before detecting a reference toner image primarily transferred on the transfer belt. At this time, since the calibration of the toner image detection sensor itself is performed by acquiring a drive value that corresponds to the temperature measured by the temperature sensor from the storage section, the calibration can be performed using such a drive value for the light emitting device that enables a sensor output voltage near the range of appropriate value for the light receiving device to be obtained. This reduces the number of iterations of calibration and consequently shortens the calibration time. In addition, since the calibration is performed using the basis material of the transfer belt, it is possible to perform subsequent calibration, such as registration correction and toner density correction, with higher precision.

Furthermore, according to the present invention, the drive value may be a current value (light emission current value) applied to the light emitting device of the toner image detection sensor.

Alternatively, the configuration of the present invention may be such that the drive value is a temperature coefficient value for a current value applied to the light emitting device of the toner image detection sensor, the temperature coefficient value being used for calculation to obtain a current value for driving the light emitting device of the toner image detection sensor. Such calculation using the temperature coefficient value to obtain the current value applied to the toner image detection sensor enables fine-grained setting of a current value to start calibration.

Furthermore, the configuration of the present invention is such that a drive value that corresponds to the temperature that has been measured by the temperature sensor and stored in the storage section is rewritten into a drive value for the toner image detection sensor at the completion of calibration. Such rewriting (updating) of the drive value for each execution of calibration enables the next execution of calibration using the rewritten drive value to be started from a drive value that is close to a drive value with which calibration is completed (i.e., a drive value with which the sensor output voltage of the light receiving device falls within the appropriate value range), thus further shortening the calibration time. That is, the next execution of calibration of the toner image detection sensor can be started from a drive value that is closer to current operational conditions.

Furthermore, the image forming apparatus according to the present invention is configured to, when calibrating the toner image detection sensor, acquire a drive value from the storage section based on the temperature measured by the temperature sensor, drive the light emitting device of the toner image detection sensor at the acquired drive value, and if a detected light received value of the light receiving device in that moment is not within a predetermined appropriate value range, repeat a process of modifying the drive value by a first range of modification so that the detected light received value approaches the appropriate value range and then again driving the light emitting device until the detected light received value falls within the appropriate value range. That is, the first range of modification is set large for repetitions of calibration, which enables the detected light received value of the light receiving device to approach the appropriate value range earlier. This reduces the number of iterations of calibration.

Alternatively, the image forming apparatus according to the present invention may be configured to, when calibrating the toner image detection sensor, acquire a drive value from the storage section based on the temperature measured by the temperature sensor, drive the light emitting device of the toner image detection sensor at the acquired drive value, and if a detected light received value (sensor output voltage) of the light receiving device in that moment is not within a predetermined appropriate value range, repeat a process of modifying the drive value by a first range of modification so that the detected light received value approaches the appropriate value range, then again driving the light emitting device, and if the detected light received value of the light receiving device in that moment is not within the appropriate value range, modifying the drive value by a second range of modification that is smaller than the first range of modification so that the detected light received value approaches the appropriate value range and then again driving the light emitting device, until the detected light received value falls within the appropriate value range. That is, the first range of modification is set large for repetitions of the calibration, which enables the detected light received value of the light receiving device to approach the appropriate value range earlier. This reduces the number of iterations of calibration.

Alternatively, the image processing apparatus according to the present invention may be configured to, when calibrating the toner image detection sensor, terminate the calibration and issue an error notification when the detected light received value (sensor output voltage) does not fall within the appropriate value range even after the number of iterations of calibration has reached a predetermined number of times. In cases where the detected light received value does not fall within the appropriate value range even after repetitions of the calibration, it is conceivable that there are causes other than the toner image detection sensor. Thus, terminating the calibration immediately and issuing an error notification enables the user to be notified of a possibility of other problems with the apparatus itself including the toner image detection sensor.

Furthermore, the image forming apparatus according to the present invention may be configured to include a shutter between the toner image carrier and the toner image detection sensor, the shutter being provided close to the toner image carrier in a situation where the shutter is closed so as to protect a detection surface of the toner image detection sensor. Such provision of the shutter prevents dirt on the sensor surface due to, for example, the adherence of transferred toners, thus further increasing the precision of calibration.

In this case, the shutter is configured to be opened when executing calibration. Such opening of the shutter only at the time of execution of calibration prevents unexpected dirt from sticking on the sensor surface.

Furthermore, in the image forming apparatus according to the present invention, a pattern for correcting image quality is used as a reference toner image. This use of the pattern for correcting image quality as a reference toner image facilitates subsequent image quality correction.

A method for calibrating a toner image detection sensor according to the present invention is performed in an image forming apparatus that includes a toner image carrier that carries a toner image, the toner image detection sensor that detects a reference toner image on the toner image carrier, a temperature sensor that detects a temperature in the apparatus, and storage section for storing a correlation between each temperature and a drive value for the toner image detection sensor. The method for calibrating the toner image detection sensor includes a step of acquiring a corresponding drive value from the storage section based on the temperature measured by the temperature sensor and a step of driving the toner image detection sensor at the acquired drive value so as to perform the calibration. By using the drive value based on the measured temperature for execution of the calibration, the calibration can be started from a drive value that is near the appropriate value range, which shortens the calibration time.

Another method for calibrating a toner image detection sensor according to the present invention is performed in an image forming apparatus that includes a toner image carrier that carries a toner image, the toner image detection sensor that detects a reference toner image on the toner image carrier and includes a light emitting device and a light receiving device, a temperature sensor that detects a temperature in the apparatus, and storage section for storing a correlation between each temperature and a drive value for the light emitting device of the toner image detection sensor. The method for calibrating the toner image detection sensor includes a first step of acquiring a corresponding drive value from the storage section based on the temperature measured by the temperature sensor, a second step of driving the light emitting device of the toner image detection sensor at the acquired drive value, a third step of, if a detected light received value of the light receiving device in that moment is not within a predetermined appropriate value range, modifying the drive value by a first range of modification so that the detected light received value approaches the appropriate value range, and a fourth step of driving the light emitting device at the drive value acquired by the modification with the first range of modification, in which processing of the third and fourth steps is repeated until the detected light received value falls within the appropriate value range. That is, the first range of modification is set large for repetitions of the calibration, which enables the detected light received value of the light receiving device to approach the appropriate value range earlier. This reduces the number of iterations of calibration.

Still another method for calibrating a toner image detection sensor according to the present invention is performed in an image forming apparatus that includes a toner image carrier that carries a toner image, a toner image detection sensor that detects a reference toner image on the toner image carrier and includes a light emitting device and a light receiving device, a temperature sensor that detects a temperature in the apparatus, and storage section for storing a correlation between each temperature and a drive value for the light emitting device of the toner image detection sensor. The method for calibrating the toner image detection sensor includes a first step of acquiring a corresponding drive value from the storage section based on the temperature measured by the temperature sensor, a second step of driving the light emitting device of the toner image detection sensor at the acquired drive value, a third step of, if a detected light received value of the light receiving device in that moment is not within a predetermined appropriate value range, modifying the drive value by a first range of modification so that the detected light received value approaches the appropriate value range, a fourth step of driving the light emitting device at the drive value acquired by the modification with the first range of modification, a fifth step of, if the detected light received value of the light receiving device in that moment is not within the appropriate value range, modifying the drive value by a second range of modification that is smaller than the first range of modification so that the detected light received value approaches the appropriate value range, and a sixth step of driving the light emitting device at the drive value acquired by the modification with the second range of modification, wherein processing of the third to sixth steps is repeated until the detected light received value falls within the appropriate value range. That is, the first range of modification is set large for repetitions of the calibration, which enables the detected light received value of the light receiving device to approach the appropriate value range earlier. This reduces the number of iterations of calibration.

DESCRIPTION OF THE PREFERRED EMBODIMENTS

Hereinafter, an embodiment of the present invention will be described with reference to the drawings. Note that the embodiment described below is merely an example that embodies the invention and is not intended to limit the scope of the invention.

Description of Overall Configuration of Image Forming Apparatus

Figure 1:
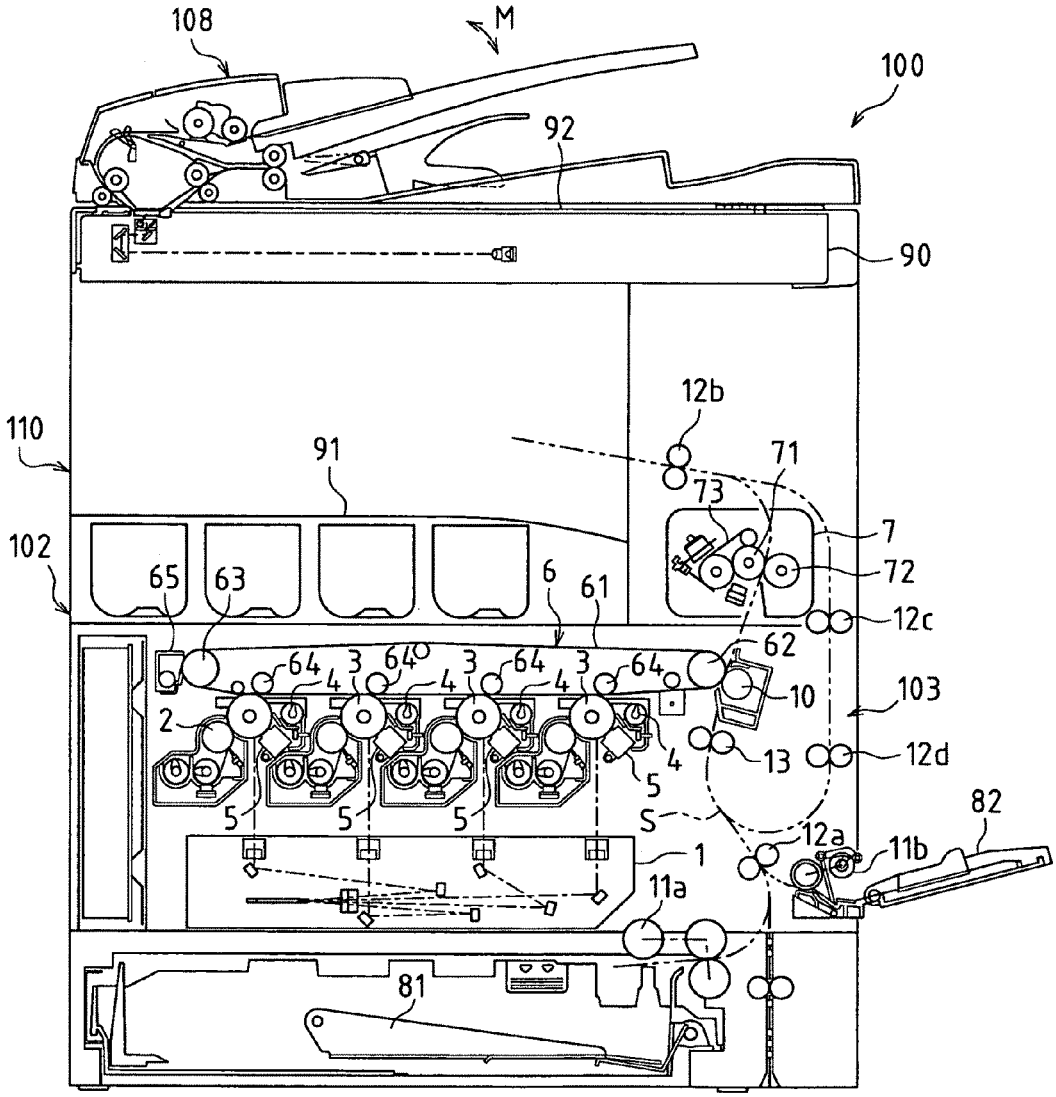
FIG. 1 is a schematic cross-sectional view showing an overall configuration of an image forming apparatus as viewed from the front, according to an embodiment.

FIG. 1 is a schematic cross-sectional view showing an overall configuration of an image forming apparatus as viewed from the front, according to the present embodiment.

In FIG. 1, an image forming apparatus 100 according to the present embodiment is configured to form multicolor and single-color images on predetermined paper (recording paper) in accordance with image data transmitted from the outside, and includes an automatic original processing unit 108, an image forming unit 102, and a recording paper transport system 103, the image forming unit 102 and the recording paper transport system 103 being provided inside an apparatus main body 110.

The image forming unit 102 includes an exposure unit 1, a development unit 2, a photosensitive drum 3, a cleaning unit 4, a charger 5, an intermediate transfer belt unit 6, and a fixing unit 7, for example, whereas the recording paper transport system 103 includes a paper feed cassette 81 and a discharge tray 91, for example.

An original table 92 of transparent glass on which an original is placed is provided on top of the apparatus main body 110, and an optical unit 90 for reading an original is provided under the original table 92. Furthermore, the automatic original processing unit 108 is provided above the original table 92. The automatic original processing unit 108 automatically transports an original onto the original table 92. The original processing unit 108 is configured to be rotatable in the direction indicated by arrow M so that a user is allowed to place an original by hand by opening the top of the original table 92.

The image forming apparatus 100 according to the present invention processes image data in accordance with a color image of each of colors black (K), cyan (C), magenta (M), and yellow (Y). Accordingly, four sets of the development unit 2, the photosensitive drum 3, the charger 5, and the cleaning unit 4 are provided and assigned to black, cyan, magenta, and yellow, respectively, so as to form 4 kinds of latent images corresponding to the respective colors, which constitute four image stations.

The chargers 5 are charging means for charging the surfaces of the photosensitive drums 3 uniformly with a predetermined electrical potential, and they may be contact-type chargers, such as roller-type chargers or brush-type chargers, other than the charger types shown in FIG. 1.

The exposure unit 1 is configured as a laser scanning unit (LSU) that includes a laser emitting part and a reflecting mirror, for example. The exposure unit 1 has arranged therein a polygon mirror that scans laser beams and an optical device such as a lens or a mirror that guides laser light reflected from the polygon mirror to the photosensitive drum 3. As an alternative technique, the exposure unit 1 may be an EL writing head or an LED writing head in which light-emitting devices are lined up in an array.

The exposure unit 1 has the functions of exposing the charged photosensitive drums 3 with light in accordance with input image data and thereby forming electrostatic latent images corresponding to the image data on the surfaces of the photosensitive drums 3.

The development units 2 are each configured to make an electrostatic latent image formed on the photosensitive drum 3 into a visible image using toners of four colors (Y, M, C, and K). The cleaning units 4 are each configured to remove and collect the residual toner remaining on the photosensitive drum 3 after development and image transfer.

The intermediate transfer belt unit 6 located above the photosensitive drums 3 includes an intermediate transfer belt (the transfer belt as claimed) 61, an intermediate transfer belt drive roller 62, an intermediate transfer belt idler roller 63, intermediate transfer rollers 64, and an intermediate transfer belt cleaning unit 65. The intermediate transfer rollers 64 are provided for each of the colors Y, M, C, and K, respectively, i.e., four intermediate transfer rollers 64 are provided.

The intermediate transfer belt 61 is stretched over the intermediate transfer belt drive roller 62, the intermediate transfer belt idler roller 63, and the intermediate transfer rollers 64 so as to be rotationally driven. Also, the intermediate transfer rollers 64 apply a transfer bias to transfer toner images on the photosensitive drums 3 onto the intermediate transfer belt 61.

The intermediate transfer belt 61 is provided in contact with the photosensitive drums 3. This arrangement serves to allow toner images of respective colors formed on the photosensitive drums 3 to be sequentially superimposed and transferred onto the intermediate transfer belt 61, thereby forming a color toner image (multicolor toner image) on the intermediate transfer belt 61. The intermediate transfer belt 61 is formed in an endless shape, using a film having a thickness of approximately 100 to 150 μm, for example.

The transfer of toner images from the photosensitive drums 3 to the intermediate transfer belt 61 is performed by the intermediate transfer rollers 64 provided in contact with the back side of the intermediate transfer belt 61. A high-voltage transfer bias (a high voltage of an opposite polarity (+) to the charge polarity (−) of the toners) is applied to the intermediate transfer rollers 64 in order to transfer toner images. The intermediate transfer rollers 64 are rollers that are based on a metal (e.g., stainless steel) shaft having a diameter of 8 to 10 mm and whose surfaces are covered with a conductive elastic material (e.g., EPDM or an urethane foam). Such a conductive elastic material enables a high voltage to be uniformly applied to the intermediate transfer belt 61. In the present embodiment, while the transfer electrode is roller shaped, it may also have other shapes such as a brush shape.

As described above, the electrostatic latent images that have been made visible according to each hue on the photosensitive drums 3 are superimposed on the intermediate transfer belt 61. Such superimposed image information is transferred by the rotation of the intermediate transfer belt 61 onto recording paper with a transfer roller 10 that constitutes a secondary transfer mechanism that is located in a contact position (described later) between the recording paper and the intermediate transfer belt 61. Note that the configuration of the secondary transfer mechanism is not limited to a transfer roller, and it is also possible to use a corona electrical charger or a transfer belt.

At this time, the intermediate transfer belt 61 and the transfer roller 10 are pressed against each other by a predetermined nip, and a voltage (a high voltage of an opposite polarity (+) to the charge polarity (−) of the toners) that causes the toners to be transferred to the recording paper is applied to the transfer roller 10. Moreover, in order to constantly obtain the above nip, either one of the transfer roller 10 or the intermediate transfer belt drive roller 62 is made of a hard material (such as a metal), and the other is made of a soft material such as an elastic roller (e.g., an elastic rubber roller or a foamable resin roller).

Furthermore, as described above, the intermediate transfer belt cleaning unit 65 is provided to remove and collect toners that have adhered to the intermediate transfer belt 61 due to contact with the photosensitive drums 3 or toners that are residual on the intermediate transfer belt 61 without having been transferred onto the recording paper by the transfer roller 10, since such toners can cause a color mixture of the toners during the next process. The intermediate transfer belt cleaning unit 65 includes, for example, a cleaning blade as a cleaning member that is in contact with the intermediate transfer belt 61, and the intermediate transfer belt 61 that is in contact with the cleaning blade is supported from the back side by the intermediate transfer belt idler roller 63.

The paper feed cassette 81 is a tray for accumulating recording paper for use in image formation and is provided below the exposure unit 1 of the apparatus main body 110. Recording paper for use in image formation can also be placed in the manual paper feed cassette 82. The discharge tray 91 provided in the upper part of the apparatus main body 110 is a tray for accumulating printed recording paper face-down.

The apparatus main body 110 is also provided with a substantially vertical paper transport path S for transporting recording paper in the paper feed cassette 81 and the manual paper feed cassette 82 to the transfer roller 10 or to the discharge tray 91 through the fixing unit 7. Pickup rollers 11*a* and 11*b*, multiple transport rollers 12*a* to 12*d*, a registration roller 13, the transfer roller 10, and the fixing unit 7, for example, are located in the vicinity of the paper transport path S from the paper feed cassette 81 or the manual paper feed cassette 82 to the discharge tray 91.

The transport rollers 12*a* to 12*d* are small rollers that facilitate and assist the transport of recording paper and are provided along the paper transport path S. The pickup roller 11*a* is provided in the vicinity of an end portion of the paper feed cassette 81, and picks up sheets of recording paper one by one from the paper feed cassette 81 and supplies them to the paper transport path S. Similarly, the pickup roller 11*b* is provided in the vicinity of an end portion of the manual paper feed cassette 82, and picks up sheets of recording paper one by one from the manual paper feed cassette 82 and supplies them to the paper transport path S.

The registration roller 13 is configured to temporarily hold recording paper that is being transported on the paper transport path S. It has the functions of transporting the recording paper to the transfer roller 10 at the time when the edges of toner images on the photosensitive drums 3 are aligned with the edge of the recording paper.

The fixing unit 7 includes a heat roller 71 and a pressure roller 72, which are configured to rotate while holding the recording paper therebetween. The heat roller 71 is also set at a predetermined fixing temperature by a control unit, based on a signal from a temperature sensor not shown, and the temperature roller 71 and the pressure roller 72 have the functions of thermally press-bonding the toners to the recording paper so that the multicolor toner image that has been transferred to the recording paper is melted, mixed, pressure welded, and thereby thermally fixed to the recording paper. The fixing unit 7 is also provided with an external heating belt 73 for heating the heat roller 71 from the outside.

Next a description is given regarding the paper transport path.

As described above, the image forming apparatus 100 is provided with the paper feed cassette 81 that stores recording paper in advance, and the manual paper feed cassette 82. In order to feed the recording paper from the paper feed cassettes 81 and 82, the pickup rollers 11*a* and 11*b* are respectively located so as to guide sheets of recording paper one by one to the paper transport path S.

The recording paper transported from the paper feed cassettes 81 and 82 is transported to the registration roller 13 by the transport roller 12*a* on the paper transport path S and then to the transfer roller 10 at the time when the edge of the recording paper and the edge of image information on the intermediate transfer belt 61 are aligned with each other, by which the image information is written on the recording paper. Thereafter, the recording paper passes through the fixing unit 7 so that unfixed toners on the recording paper are melted and fixed by heat, and the paper is then discharged on the discharge tray 91 through the transport roller 12*b* located downstream.

The above-described paper transport path is used to meet a request for simplex printing on recording paper, whereas for a request for duplex printing, the transport roller 12*b* is inversely rotated after simplex printing is completed as described above and the tailing edge of the recording paper applied to the fixing unit 7 is grasped by the last transport roller 12*b*, whereby the recording paper is guided to the transport rollers 12*c* and 12*d*. Then, the back side of the recording paper is printed through the registration roller 13 located downstream, and the recording paper is discharged on the discharge tray 91.

The above is a description of the overall configuration of the image forming apparatus.

Description of Structures Around Intermediate Transfer Belt Unit

Figure 2:
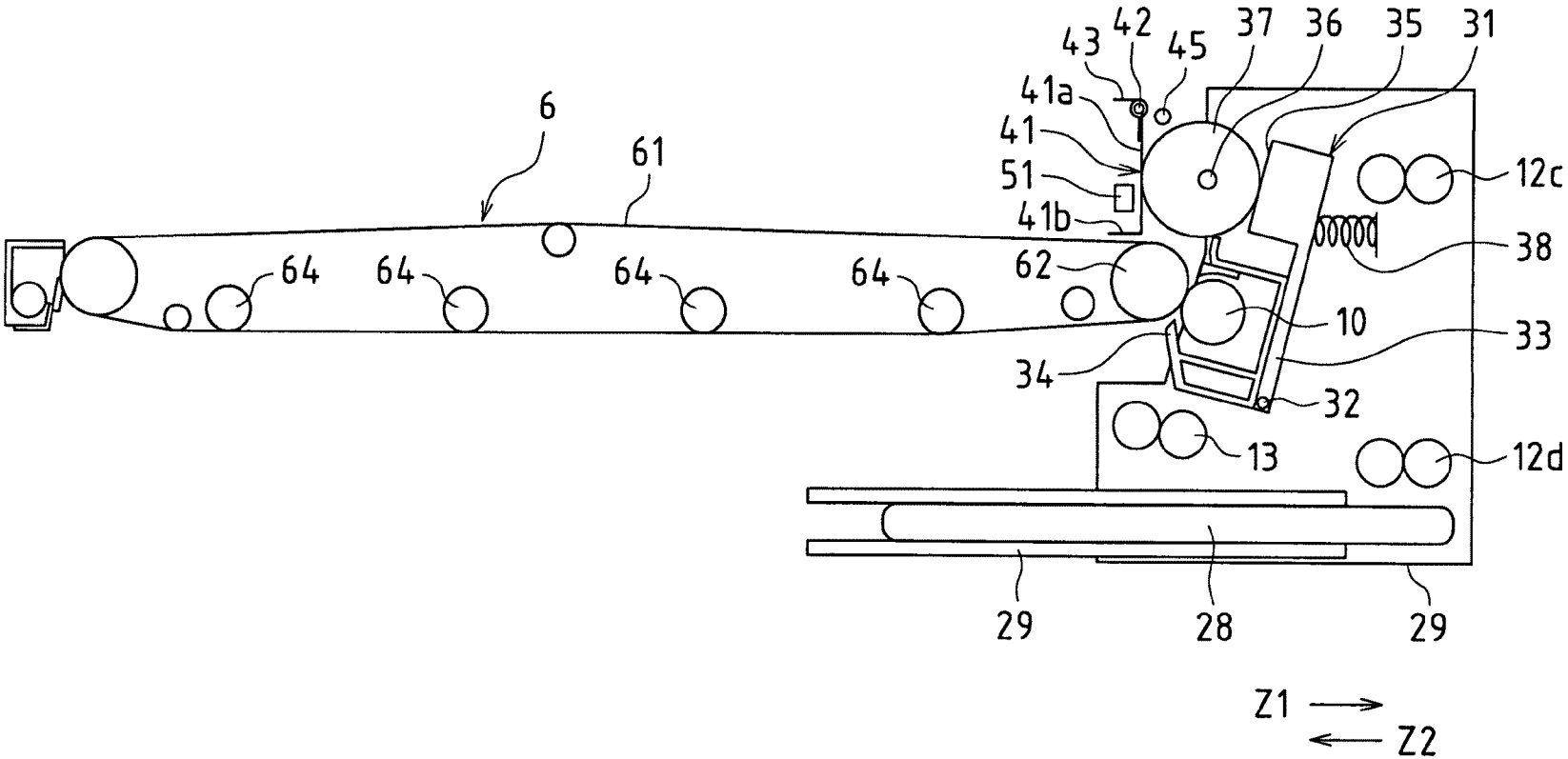
FIG. 2 is a schematic front view showing structures around an intermediate transfer belt unit of the image forming apparatus according to the embodiment.
Figure 3:
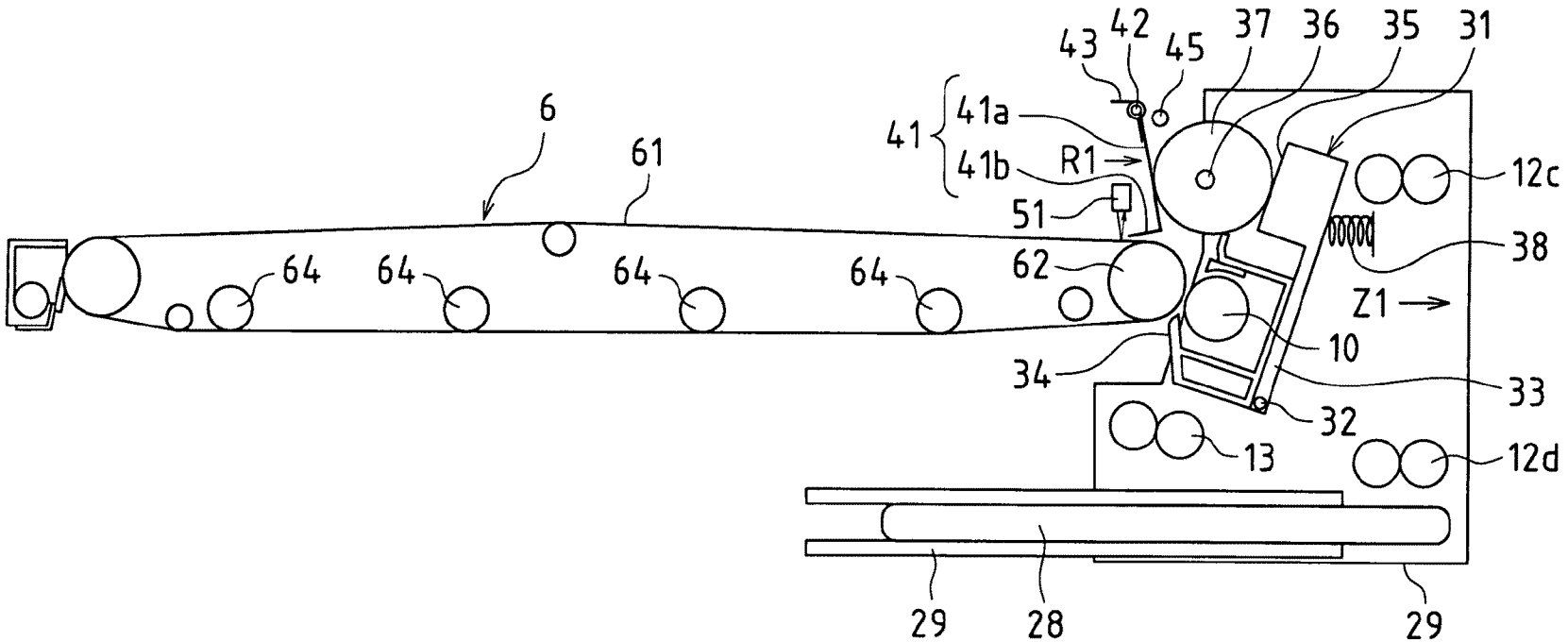
FIG. 3 is a schematic front view showing the structures around the intermediate transfer belt unit of the image forming apparatus according to the embodiment.

Next is a description of structures around the intermediate transfer belt unit 6 with reference to the schematic front views of FIGS. 2 and 3 showing the structures around the intermediate transfer belt unit.

In the present embodiment, a secondary transfer unit 31 including the transfer roller 10 is attached to a side unit 28 that is located on the intermediate transfer belt drive roller 62 side of the intermediate transfer belt 61. This secondary transfer unit 31 corresponds to the aforementioned secondary transfer mechanism.

The side unit 28 is provided to slide along a guardrail 29 provided in a device frame not shown, so as to be withdrawable from (in the drawing, in the direction indicated by arrow Z1) and insertable into (in the drawing, in the direction indicated by arrow Z2) the apparatus main body 110.

The secondary transfer unit 31 includes a pivotable plate 33 whose lower end portion is mounted so as to be pivotable on a support shaft 32 relative to the side unit 28, and a roller case 34 that holds the transfer roller 10 rotatably is fixed to the lower side of the pivotable plate 33. In other words, pivoting movements of the pivotable plate 33 on the support shaft 32 bring the transfer roller 10 into abutting contact with or apart from the intermediate transfer belt 61 that is wound around the intermediate transfer belt drive roller 62.

Meanwhile, the upper side of the pivotable plate 33 forms a cam contact surface 35 that bulges toward the intermediate transfer belt unit 6, and the cam contact surface 35 is brought into abutting contact with a cam surface of an eccentric cam 37 that is rotatably held by the cam shaft 36. The eccentric cam 37 is driven by an eccentric cam drive motor not shown.

Also, an elastic member 38 such as a coil spring for biasing the cam contact surface 35 into abutting contact with the cam surface of the eccentric cam 37 is provided between the opposite side surface of the cam contact surface 35 and the side unit 28. The elastic member 38 enables the cam contact surface 35 of the pivotable plate 33 to be constantly in abutting contact with (pressed against) the cam surface of the eccentric cam 37.

In a situation where the cam contact surface 35 is in abutting contact with a portion of the cam surface that is closest to the center of the eccentric cam 37 (the situation shown in FIG. 2), the transfer roller 10 is positioned in abutting contact with the intermediate transfer belt 61 under a predetermined nip pressure. This situation occurs during normal operation (image forming operation) of the present image forming apparatus 100.

In a situation where the cam contact surface 35 is in abutting contact with a portion of the cam surface that is most distant from the center of the eccentric cam 37 (the situation shown in FIG. 3), the transfer roller 10 is positioned apart from the intermediate transfer belt 61. This situation occurs during operation other than normal operation (operation other than image forming operation) of the present image forming apparatus 100.

Furthermore, an L-shaped shutter 41 is located in a position so as to face the cam contact surface 35 of the pivotable plate 33 with the eccentric cam 37 therebetween, with its vertical surface 41*a* being in abutting contact with the cam contact surface 35. The shutter 41 has the vertical surface 41*a* whose upper end portion is supported by the device frame not shown so as to be rotatable on a shutter support shaft 42, and also has a horizontal surface 41*b* that is bent into an L shape at the bottom and positioned opposed to an optical sensor (the toner image detection sensor as claimed) 51 that is positioned so as to vertically face the intermediate transfer belt 61 with a constant distance therebetween. In other words, the horizontal surface 41*b* of the shutter 41 is positioned between the optical sensor 51 and the intermediate transfer belt 61.

The optical sensor 51 is a reflecting optical sensor that includes a light emitting device (LED) 51*a* and a light receiving device (phototransistor) 51*b*. The optical sensor 51 is used to detect a reference toner image formed on the intermediate transfer belt 61 during image quality correction processing described later and to detect whether the shutter 41 is open or closed.

A torsion coil spring 43 is mounted to the shutter support shaft 42 of the shutter 41 positioned as described, with one end of the torsion coil spring 43 being fixed to the device frame and the other end being in abutting contact with the vertical surface 41*a* so that the vertical surface 41*a* is biased toward the cam surface of the eccentric cam 37.

In the situation where the vertical surface 41*a* is in abutting contact with the portion of the cam surface that is most distant from the center of the eccentric cam 37 (the situation shown in FIG. 2), the horizontal surface 41*b* is inserted between the optical sensor 51 and the intermediate transfer belt 61 so as to protect the detection surface of the optical sensor 51 (i.e., the shutter 41 is closed). In the situation where the vertical surface 41*a* is in abutting contact with the portion of the cam surface that is closest to the center of the eccentric cam 37 (the situation shown in FIG. 3), the horizontal surface 41*b* rotates toward the side unit 28 by an eccentric quantity of the eccentric cam 37 and retracts from the detection surface of the optical sensor 51 (i.e., the shutter 41 is opened) (see FIG. 4A). That is, the shutter 41 is opened and closed during a single rotation of the eccentric cam 37.

The device frame in the vicinity of the shutter support shaft 42 is also provided with a shutter regulating member (regulation pin) 45 that regulates rotational movement of the shutter 41. The shutter regulating member 45 is provided in such a position as not to affect oscillating movement of the shutter 41 associated with rotational movement of the eccentric cam 37 (i.e., oscillating movement is not regulated). Meanwhile, when the side unit 28 slides out of the device main body in the direction Z1 so as to remove the intermediate transfer belt unit 6, the eccentric cam 37 moves together with the side unit 28 in the direction Z1, and the shutter 41 is rotated in a direction R1 (see FIG. 3) by the biasing force of the torsion coil spring 43 and brought into abutting contact with the shutter regulating member 45, whereby rotational movement of the shutter 41 is regulated. At this time, the shutter 41 (more precisely, the end portion of the horizontal surface 41*b* of the shutter 41) is most distant from the intermediate transfer belt 61. This regulation position is set so that when the side unit 28 is inserted into the device main body by being pressed into the direction Z2 after the intermediate transfer belt unit 6 has been mounted, the shutter 41 is rotated to a position (the position shown in FIG. 2) to protect the detection surface of the optical sensor 51 with its vertical surface 41*a* being in abutting contact with the cam surface of the eccentric cam 37.

In the above configuration, the transfer roller 10, the eccentric cam 37, and the shutter 41 are positioned as shown in FIG. 2 during normal operations (image forming operations) of the present image forming apparatus 100. Specifically, the cam contact surface 35 of the rotation plate 33 is in abutting contact with the portion of the cam surface that is closest to the center of the eccentric cam 37, and the transfer roller 10 is positioned in abutting contact with the intermediate transfer belt 61 by a predetermined nip pressure. The vertical surface 41*a* of the shutter 41 is in abutting contact with the portion of the cam surface that is most distant from the center of the eccentric cam 37, and the horizontal surface 41*b* is inserted between the optical sensor 51 and the intermediate transfer belt 61 so as to protect the detection surface of the optical sensor 51 (i.e., the shutter 41 is closed) (see FIG. 4B). This prevents paper dust or the like on recording paper passing between the intermediate transfer belt 61 and the transfer roller 10 from adhering to the detection surface of the optical sensor 51.

Figure 4:
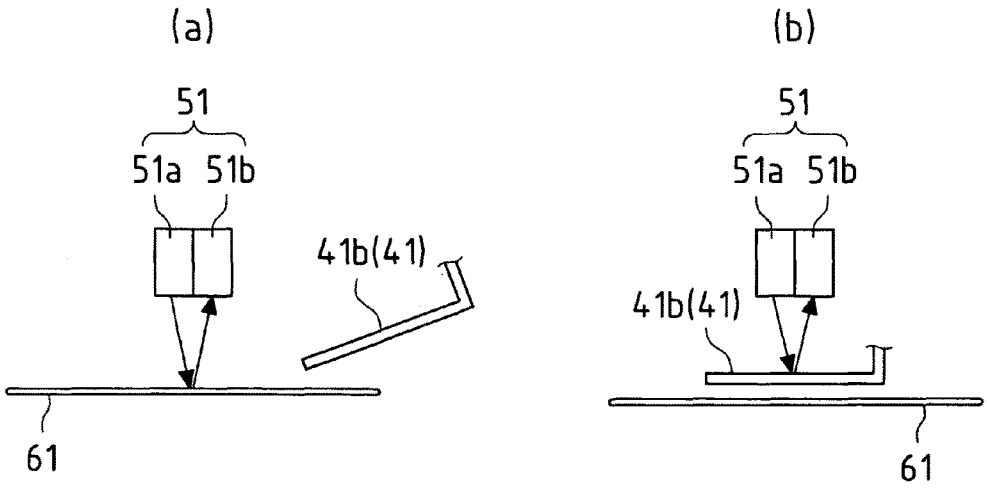
FIG. 4A is an explanatory drawing showing the relative positions of an optical sensor, a shutter, and an intermediate transfer belt in the image forming apparatus according to the embodiment.
FIG. 4B is an explanatory drawing showing the relative positions of the optical sensor, the shutter, and the intermediate transfer belt in the image forming apparatus according to the embodiment.

Note that whether the shutter 41 is open or closed can be detected with the optical sensor 51. Specifically, as described above, with the shutter being closed, the detection surface of the optical sensor 51 is shielded by the shutter 41 from the intermediate transfer belt 61 as shown in FIG. 4B, so that incident light from the light emitting device 51*a* is reflected by the shutter 41 and the reflected light is received by the light receiving device 51*b*. On the other hand, with the shutter being open, the detection surface of the optical sensor 51 is exposed to the intermediate transfer belt 61 as shown in FIG. 4A, so that incident light from the light emitting device 51*a* of the optical sensor 51 is reflected off the intermediate transfer belt 61 and the reflected light is received by the light receiving device 51*b*.

Figure 5:
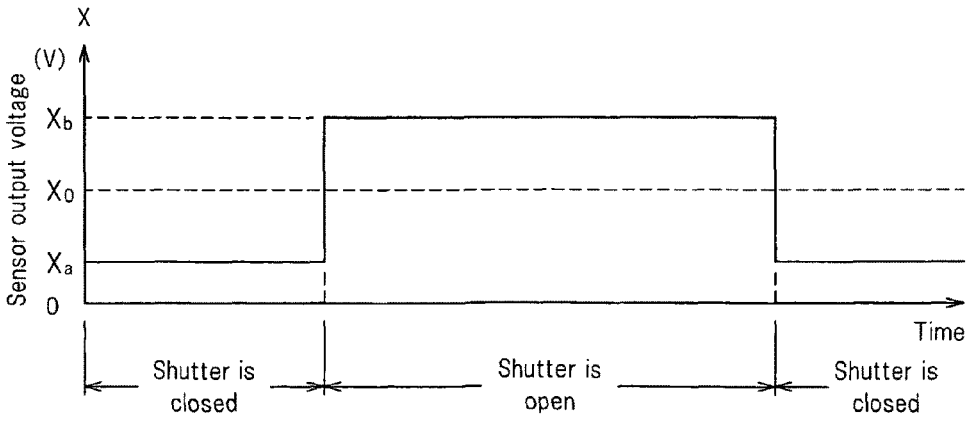
FIG. 5 is a graph showing a relationship between a sensor output voltage of the optical sensor and opening and closing of the shutter in the image forming apparatus according to the embodiment.

In detecting whether the shutter 41 is open or closed with the optical sensor 51, a predetermined open/closed detection reference voltage (X0) is used as a reference sensor output voltage X for determining whether the shutter is open or closed. Specifically, as shown in FIG. 5, the shutter 41 is detected as being closed when the sensor output voltage X is lower than or equal to the open/close detection reference voltage (X0), and the shutter 41 is detected as being open when the sensor output voltage X is higher than or equal to the open/close detection reference voltage (X0).

Note that, in this case, the initial open/close detection reference voltage (X0) is generally set so as to be higher than the sensor output voltage (Xa in FIG. 5) obtained in the case where incident light from the light emitting device 51*a* of the optical sensor 51 is reflected by the shutter 41 and the reflected light is received by the light receiving device 51*b* (FIG. 4B) and to be lower than the sensor output voltage (Xb in FIG. 5) obtained in the case where incident light from the light emitting device 51*a* of the optical sensor 51 is reflected off the intermediate transfer belt 61 and the reflected light is received by the light receiving device 51*b* (FIG. 4A).

By the way, the present image forming apparatus 100, which is an intermediate transfer color image forming apparatus, performs registration correction in order to avoid color shifts in a multicolor image formed on the intermediate transfer belt 61. The apparatus also performs other image quality correction processing at a predetermined or arbitrary time, such as high density correction for reducing variability in the overall density of an image that is subjected to image formation processing and gray level correction for reducing variability in the tone of toner images.

The aforementioned image quality correction processing needs to be performed when the present image forming apparatus 100 is not performing normal operations (image forming operations). In other words, the image quality correction processing including registration correction, high density correction, and gray level correction is performed when the shutter 41 is open.

Figure 6A:
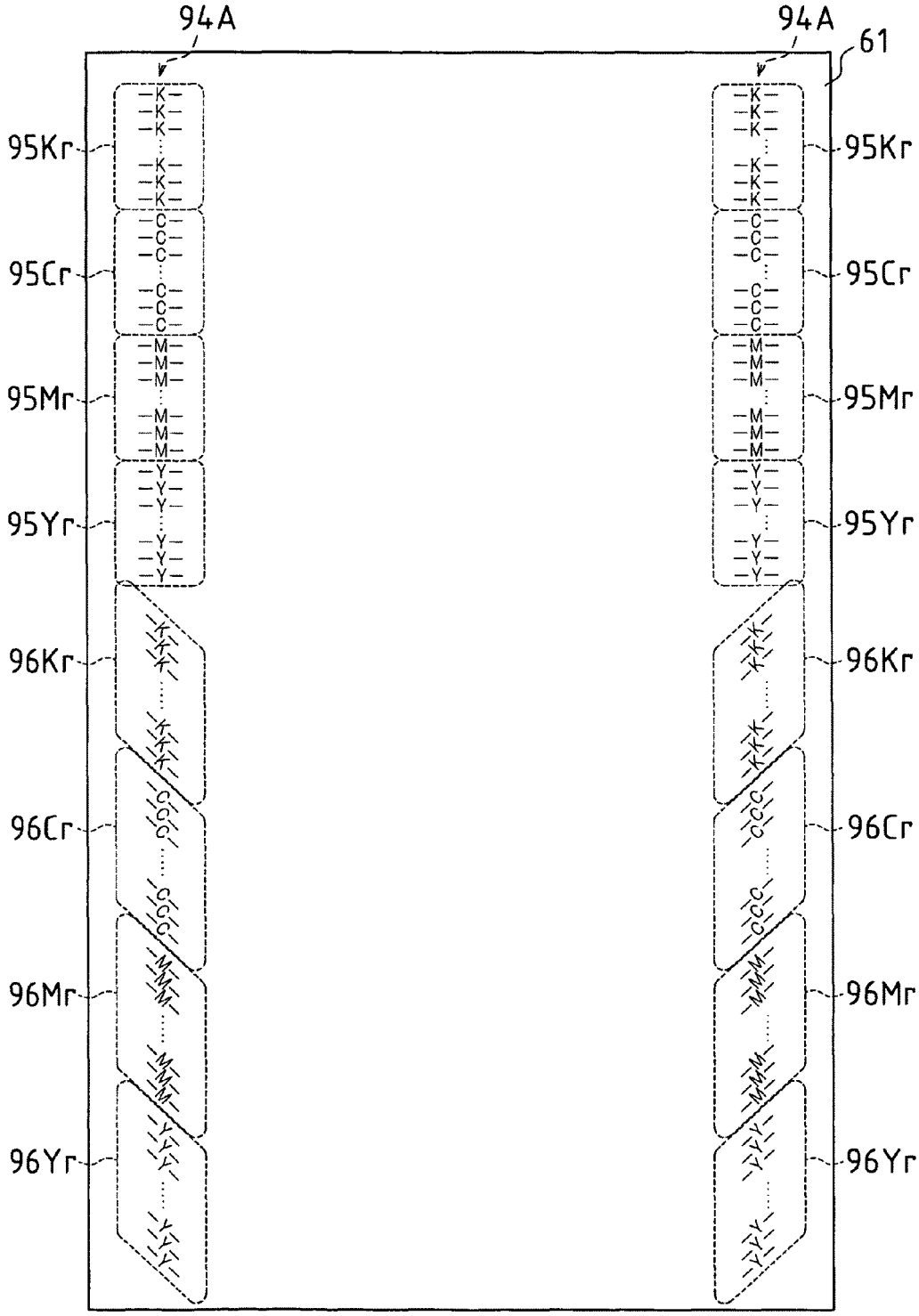
FIG. 6A is an explanatory drawing showing an example of a registration pattern used for registration correction processing.

In the intermediate transfer image forming apparatus, registration correction processing is performed in order to automatically adjust intermediate transfer by checking the presence or absence of color shifts between images of respective colors that have been primarily transferred from the photosensitive drums of the respective colors. To check the presence or absence of such color shifts, the optical sensor 51*a* is used to detect a registration pattern (reference toner image) 94A formed on the intermediate transfer belt 61 as shown in FIG. 6A. It is however noted that the registration pattern in FIG. 6A is merely one example, in which patterns 95Kr, 95Cr, 95Mr, and 95Yr for correction in the main scanning direction and patterns 96Kr, 96Cr, 96Mr, and 96Yr for correction in the sub-scanning direction are each configured with 17 rows of line patterns.

Figure 6B:
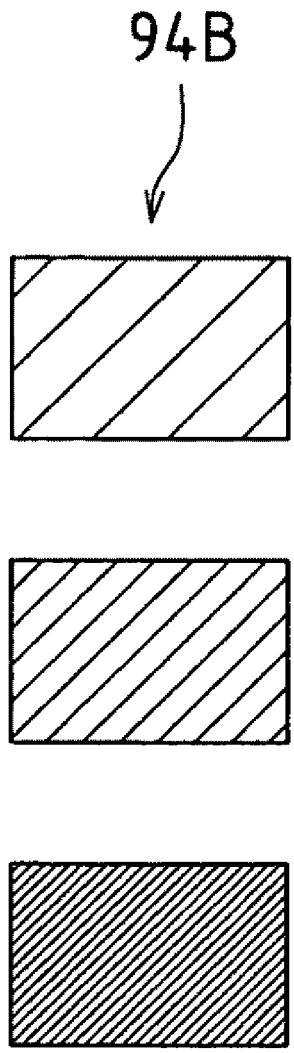
FIG. 6B is an explanatory drawing showing an example of an advance test pattern used for high density correction processing.
Figure 6C:
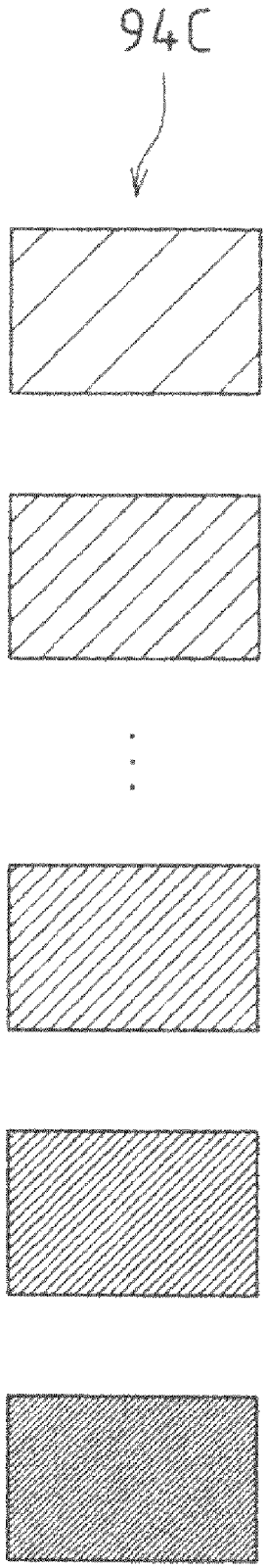
FIG. 6C is an explanatory drawing showing an example of a correction test pattern used for gray level correction processing.

In high density correction processing, as shown in FIG. 6B, a single test pattern (advance test pattern) showing a series of changes from high density to low density is primarily transferred from the photosensitive drums 3 on the intermediate transfer belt 61, and the toner density of this test pattern (reference toner image) 94B is detected with the optical sensor 51. In gray level correction processing, as shown in FIG. 6C, multiple test patterns (correction test patterns) with different gradations are primarily transferred from the photosensitive drums 3 to the intermediate transfer belt 61, and the toner density of those test patterns (reference toner images) 94C is detected with the optical sensor 51.

In detecting such a pattern as a registration pattern and a test pattern that is formed on the intermediate transfer belt 61, calibration of the optical sensor 51 itself is performed before detecting such a registration pattern and a test pattern, which operation will be described later.

Figures 7, 8:
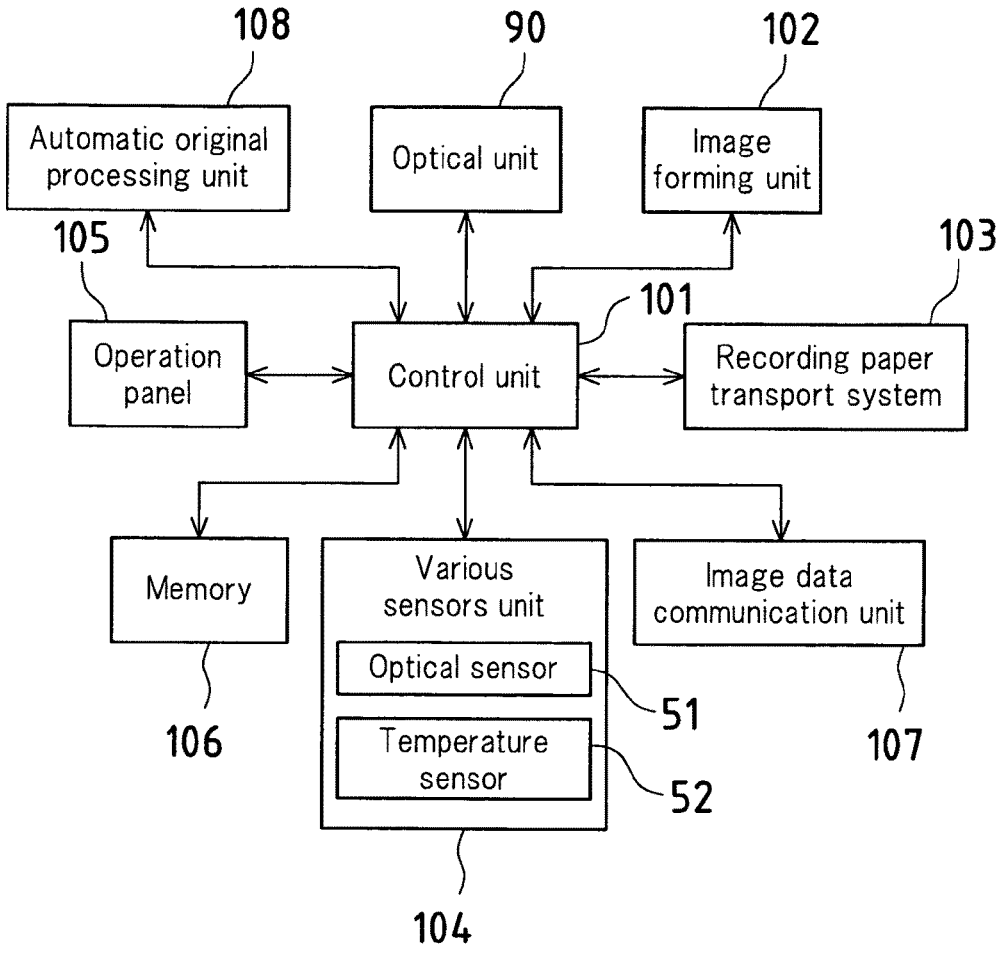
FIG. 7 is a block diagram showing an example configuration of a control system in the image forming apparatus according to the embodiment.
FIG. 8 is an explanatory drawing showing an example of a temperature correction table stored in a memory.

FIG. 7 is a block diagram showing an example configuration of a control system in the image forming apparatus 100 with the above configuration. The following description is given regarding the control system with reference to the block diagram of FIG. 7.

A control unit 101 of the present image forming apparatus 100 sequentially controls and manages the drive mechanisms of the image forming apparatus 100, including the automatic original processing unit 108, the optical unit 90, the image forming unit 102, and the recording paper transport system 103, as well as outputting a control signal to each unit based on detected values from a various sensors unit 104 that includes, for example, the optical sensor 51 and a temperature sensor 52 that detects the temperature in the apparatus. Note that, while the temperature sensor 52 is located in the vicinity of the optical sensor 51, for example, it has been omitted from FIGS. 1 to 3.

The control unit 101 includes a CPU, a ROM, and a RAM, for example. The ROM stores a variety of control information (control programs) that is necessary to control the drive mechanisms constituting the image forming apparatus 100. The CPU reads, opens in the RAM, and executes the control programs stored in the ROM, thereby controlling various operations.

The control unit 101 is connected to an operation panel 105 (not shown in FIG. 1) that is provided on the upper front side of the apparatus main body 110 such that communication is possible between the control unit 101 and the operation panel 105, and the image forming apparatus 100 operates in accordance with print processing conditions that have been input and set by the user by operation of the operation panel 105. The control unit 101 is also connected to a memory 106 and an image data communication unit 107.

The memory 106 stores data such as data regarding an adjustment pattern to be formed on the intermediate transfer belt 61 during registration adjustment, data regarding an advance test pattern to be formed on the intermediate transfer belt 61 during high density correction processing, and data regarding a correction test pattern with different gradations to be formed on the intermediate transfer belt 61 during gray level correction processing.

The image data communication unit 107 is a communication unit that is provided to enable communications of information such as image information and image control signals with other digital image equipment.

The control unit 101 controls print processing operations in accordance with print processing conditions that have been input and set by the user by the operation of the operation panel 105. The control unit 101 also performs image quality correction processing (such as high density correction, gray level correction, and registration correction) for adjusting control requirements (such as a charging output, a developing bias, and a transfer bias) for each unit of the image forming unit 102 at a fixed interval in order to constantly obtain a proper image density. The control unit 101 also performs calibration of the optical sensor 51 prior to the image quality correction processing.

Description of Calibration of Optical Sensor as Feature of Invention

The following description is given regarding examples of the calibration of the optical sensor 51, which is a feature of the present invention.

In the present examples, the calibration of the optical sensor 51 itself is performed using the basis material of the intermediate transfer belt 61 on which primary transfer of a reference toner image has not yet been made, before detecting a reference toner image primarily transferred on the intermediate transfer belt 61. In other words, the calibration is performed so that the sensor output voltage X of the light receiving device 51*b*, which has received reflection of incident light emitted from the light emitting device 51*a* to the basis material of the intermediate transfer belt 61, falls within a predetermined appropriate value range Xw by controlling, i.e., increasing and reducing, the light emission current value Y of the light emitting device 51*a*. Then, the light emission current value Y that has been set by the execution of the calibration is used as a new light emission current value Y during updating, and the updated light emission current value Y is used for subsequent image quality correction processing (process control).

At this time, in the present examples, a drive value that corresponds to the temperature in the apparatus and is measured by the temperature sensor 52 is acquired from the memory 106 to perform calibration, so the calibration is performed using a drive value for the light emitting device 51*a* at which value it is possible to obtain a sensor output voltage X of the light receiving device 51*b* that is near the appropriate value range Xw. This reduces the number of iterations of calibration and consequently shortens the calibration time.

Here, the drive value may be a light emission current value Y applied to the light emitting device 51*a* of the optical sensor 51. Alternatively, the drive value may be a temperature coefficient value $\alpha$ for the light emission current value Y applied to the light emitting device 51*a* of the optical sensor 51. The following description gives specific examples in cases where the drive value is the light emission current value Y and where the drive value is the temperature coefficient value $\alpha$.

EXAMPLE 1

Example 1 shows a case where the drive value is the light emission current value Y applied to the light emitting device 51*a*. Specifically, the configuration is such that calibration is started by acquiring the light emission current value Y applied to the light emitting device 51*a* from a table (temperature correction table) that shows a correlation between temperatures and light emission current values. Thus, in Example 1, the temperature correction table is stored in the memory 106. Acquiring the light emission current value Y applied to the light emitting device 51*a* directly from the table in this way enables earlier start of calibration.

FIG. 8 shows an example of a temperature correction table 106*a* stored in the memory 106.

The temperature correction table 106*a* is divided into four temperature ranges as temperature categories, namely the range of 10° C. or below, the range of 10° C. to 30° C., the range of 30° C. to 50° C., and the range of 50° C. or above, and the light emission current value Y (mA) is associated with each of the temperature categories. In the present example, the temperature category of 10° C. or below is associated with a light emission current value of 2.12 (mA), the temperature category of 10° C. to 30° C. is assigned with a light emission current value of 2.26 (mA), the temperature division of 30° C. to 50° C. is assigned with a light emission current value of 2.40 (mA), and the temperature category of 50° C. or above is assigned with a light emission current value of 2.54 (mA). Note that the above temperature categories are merely one example, and the present invention is not limited to such four divisions. For example, it is also possible to create a temperature correction table that is divided into smaller categories, such as in units of 10° C. or in units of 5° C.

Note that each of the light emission current values Y is obtained such that a standard image forming apparatus is manufactured previously with use of a standard optical sensor and a standard intermediate transfer belt and is located under thermal environments of each temperature category as described above (e.g., under thermal environments at a center value of each category), the calibration of the optical sensor is performed in the conventional manner using a default value, and the light emission current value obtained as a result of the calibration is stored in the temperature correction table 106*a* as a light emission current value for that temperature category. That is, the temperature correction table 106*a* is obtained in advance by experiments, for example.

In the above description, while the temperature correction table 106*a* is created using a standard image forming apparatus, it is also possible to, for example, extract any one of image forming apparatuses that have been manufactured in a lot unit on the manufacturing line, create a temperature correction table by performing experiments as described above with the extracted image forming apparatus, and apply the created temperature correction table for all image forming apparatuses of that lot. In general, unevenness in the performance of various electronic components such as optical sensors often show similar characteristic in the same manufacturing lot unit, so creating a single temperature correction table in a lot unit enables an appropriate temperature correction table to be created for each image forming apparatus. Note that the method for creating a temperature correction table is not limited to the method described above, and if more precision is required for the creation, it is also possible to, for example, create an individual table for each image forming apparatus by experiments.

Figure 9:
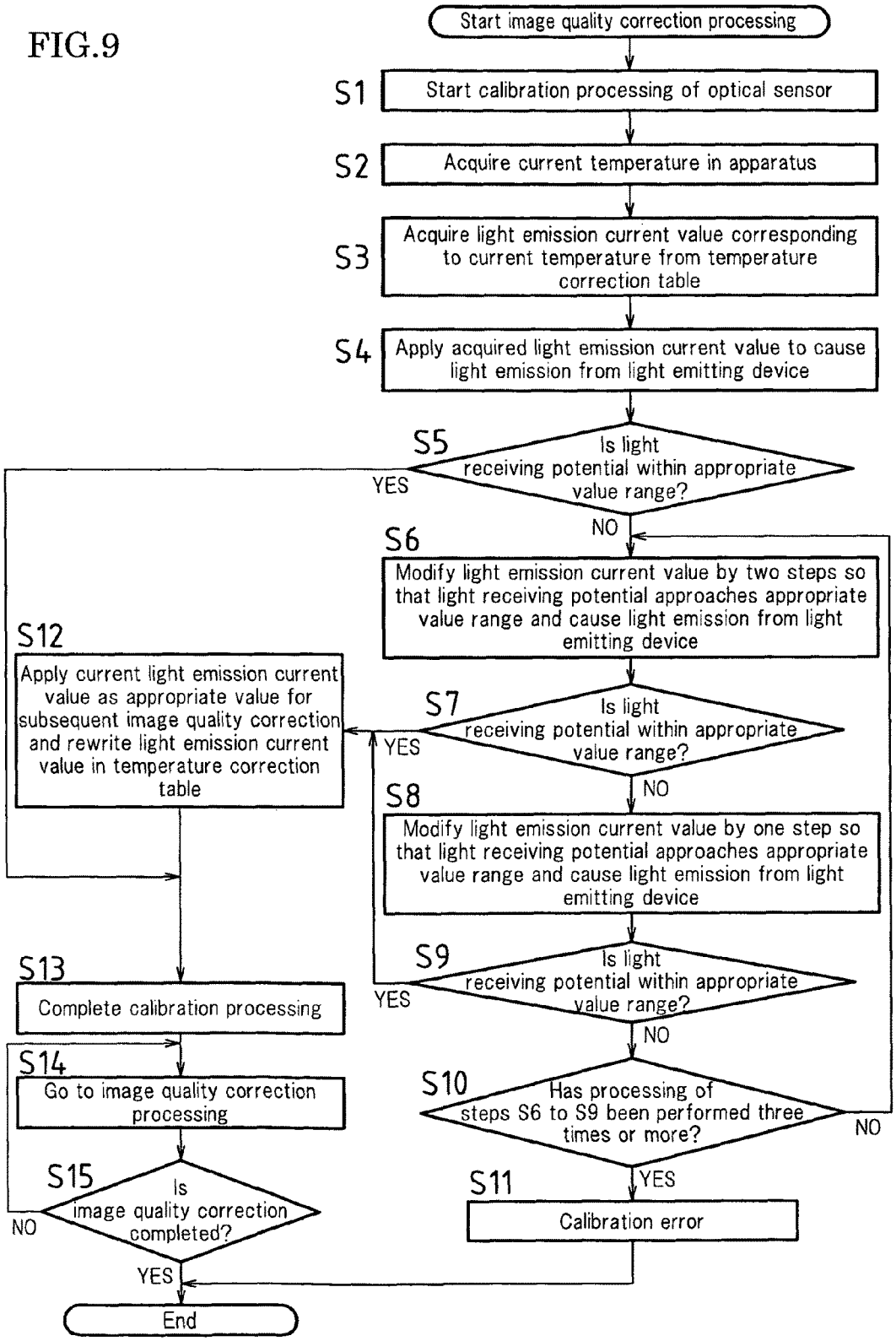
FIG. 9 is a flowchart showing a procedure of calibration processing operations according to Example 1.

FIG. 9 is a flowchart showing a procedure of calibration processing operations according to Example 1. The following description is given regarding the calibration processing operations according to Example 1 with reference to the flowchart of FIG. 9.

Upon instruction to start image quality correction processing, the control unit 101 starts calibration processing of the optical sensor 51 itself prior to image quality correction processing (step S1).

Specifically, the control unit 101 acquires the current temperature in the apparatus from the temperature sensor 52 (step S2). Then, a light emission current value Y that corresponds to the category (i.e., the category including the acquired temperature) that satisfies the acquired temperature is acquired with reference to the temperature correction table 106*a* in the memory 106 (step S3), and current is applied to the light emitting device 51*a* of the optical sensor 51 at the acquired light emission current value Y, thereby causing light emission from the light emitting device 51*a* (step S4).

For example, in a case where the current temperature acquired by the temperature sensor 52 is 20° C., a light emission current value Y of 2.26 (mA) is acquired from the temperature correction table 106*a*.

Then, the control unit 101 acquires the sensor output voltage X of the light receiving device 51*b* in this situation and determines whether or not the sensor output voltage X is within the appropriate value range Xw (step S5). Consequently, if the sensor output voltage X is within the appropriate value range Xw (YES in step S5), the process proceeds to step S13, where the calibration processing ends.

On the other hand, if the sensor output voltage X is not within the appropriate value range Xw (NO in step S5), the light emission current value is modified by a predetermined first range of modification (e.g., two steps=0.02 (mA)) so that the sensor output voltage X approaches the appropriate value range Xw, and the modified light emission current value Y is used to cause the light emitting device 51*a* to again emit light (step S6).

For example, in a case where the sensor output voltage X is lower than the appropriate value range Xw (i.e., a value below the appropriate value range Xw), modification is performed to increase the light emission current value Y by the predetermined first range of modification (two steps) so that the sensor output voltage X approaches the appropriate value range Xw. Specifically, in the case of this modification, the light emission current value Y is increased from 2.26 (mA) by 0.02 (mA) to 2.28 (mA). On the other hand, in a case where the sensor output voltage X is higher than the appropriate value range Xw (i.e., a value above the appropriate value range Xw), modification is performed to reduce the light emission current value Y by the predetermined first range of modification (two steps) so that the sensor output voltage X approaches the appropriate value range Xw. Specifically, in the case of this modification, the light emission current value is reduced from 2.26 (mA) by 0.02 (mA) to 2.24 (mA).

Then, the control unit 101 again acquires the sensor output voltage X of the light receiving device 51*b* in this situation and again determines whether or not the acquired sensor output voltage X is within the appropriate value range Xw (step S7). Consequently, if the sensor output voltage X is within the appropriate value range Xw (YES in step S7), the process proceeds to step S12.

On the other hand, if the sensor output voltage X is not within the appropriate value range Xw (NO in step S7), the light emission current value Y is modified by a predetermined second range of modification (e.g., one step=0.01 (mA)) so that the sensor output voltage X approaches the appropriate value range Xw, and the modified light emission current value Y is used to cause the light emitting device 51*a* to again emit light (step S8).

For example, if the sensor output voltage X is lower than the appropriate value range Xw (i.e., the sensor output voltage X has a value below the appropriate value range Xw) even after the light emission current value has been modified from 2.26 (mA) to 2.28 (mA) in step S6 described above, the light emission current value Y is further modified to be increased by a predetermined second range of modification (1step) so that the sensor output voltage X approaches the appropriate value range Xw. That is, in the case of this modification, the light emission current value is increased by 0.01 (mA) from 2.28 (mA) to 2.29 (mA). On the other hand, if the sensor output voltage X is higher than the appropriate value range Xw (i.e., a value above the appropriate value range Xw) even after the light emission current value Y has been modified from 2.26 (mA) to 2.24 (mA) in step S6 described above, the light emission current value Y is modified by the predetermined second range of modification (one step) so that the sensor output voltage X approaches the appropriate value range Xw. That is, in the case of this modification, the light emission current value Y is reduced by 0.01 (mA) from 2.24 (mA) to 2.23 (mA).

Then, the control unit 101 again acquires the sensor output voltage X of the light receiving device 51*b* in this situation and again determines whether or not the acquired sensor output voltage X is within the appropriate value range Xw (step S9). Consequently, if the sensor output voltage X is within the appropriate value range Xw (YES in step S9), the process proceeds to step S12.

On the other hand, if the sensor output voltage X is not within the appropriate value range Xw (NO in step S9), it is determined whether or not the above processing of steps S6 to S9 has been performed three times or more (step S10) and, if the processing has not yet been performed three times or more (NO in step S10), the process returns to step S6, in which the process of modifying the light emission current value Y by the first range of modification (two steps) is continued. On the other hand, if it is determined that the above processing of steps S6 to S9 has been performed three times or more (YES in step S10), it is determined that there are some problems with the apparatus including the optical sensor 51, so that "calibration error" is displayed on a display unit not shown (step S11) and the process ends. This enables the user to be notified of the possibility of the presence of some problems with the apparatus itself including the optical sensor 51.

Note that the determination in S10 described above may be made by, for example, providing the control unit 101 with counting means (not shown) for counting the number of iterations of calibration and determining whether or not the number of iterations counted by the counting means has reached six.

On the other hand, in step S12, which is performed when it is determined in step S7 or S9 that the sensor output voltage X is within the appropriate value range Xw, the light emission current value Y of the light emitting device 51*a* is set so that the light emission current value Y modified in step S6 or S8 is used as an appropriate value (appropriate light emission current value) for the light emitting device 51*a* in subsequent image quality correction processing. In other words, it is stored as an appropriate light emission current value Y in a predetermined area of the memory 106. The control unit 101 also rewrites the light emission current value Y in a corresponding category of the temperature correction table 106*a* stored in the memory 106 into the light emission current value Y modified in step S6 or S8.

For example, in a case where the light emission current value Y has been modified from 2.26 (mA) to 2.28 (mA) in step S6, the control unit 101 when going from step S7 to step S12 rewrites the light emission current value Y in the category of 10° C. to 30° C. in the temperature correction table 106*a* from the stored value of 2.26 (mA) to 2.28 (mA). As a result, in a case where the temperature detected by the temperature sensor 52 is a given value within the category of 20° C. to 30° C., the control unit 101 starts subsequent calibration of the optical sensor 51 after acquiring the value of 2.28 (mA) from the temperature correction table 106*a* as a light emission current value Y applied to the light emitting device 51*a*.

By in this way updating the light emission current value Y in the temperature correction table 106*a* for each execution of calibration, subsequent calibration can be performed using such an updated light emission current value Y that is closer to (or within) the appropriate value range Xw within which the light emission current value Y is required to fall in order to complete calibration. This further shortens the calibration time. In addition, such updating makes it possible to update the temperature correction table individually for each image forming apparatus by performing the calibration of the optical sensor through actual running of the image forming apparatus, although at the beginning the same temperature correction table has been stored for all image forming apparatuses in a lot unit, for example.

Then, after the calibration of the optical sensor 51 is completed (step S13), the control unit 101 performs image quality correction processing in the conventional manner, using the optical sensor 51 (step S14). Specifically, a registration pattern as shown in FIG. 6A is formed on the intermediate transfer belt 61 in registration correction processing, an advance test pattern as shown in FIG. 6B is formed on the intermediate transfer belt 61 in high density correction processing, and a correction pattern as shown in FIG. 6C is formed on the intermediate transfer belt 61 in gray level correction processing. Those patterns are read by the light receiving device 51*b*, with the light emitting device 51*a* emitting light with an appropriate light emission current value Y stored in a predetermined area of the memory 106, and correction processing is performed using those patterns. After such image quality correction processing is completed (YES in step S15), the entire process ends.

According to Example 1 described above, an initial range of modification is set to be large (two steps) for repetition of the calibration from steps S6 to S10, which enables the sensor output voltage X of the light receiving device 51*b* to approach the appropriate value range Xw earlier. This reduces the number of iterations of calibration.

Figure 10:
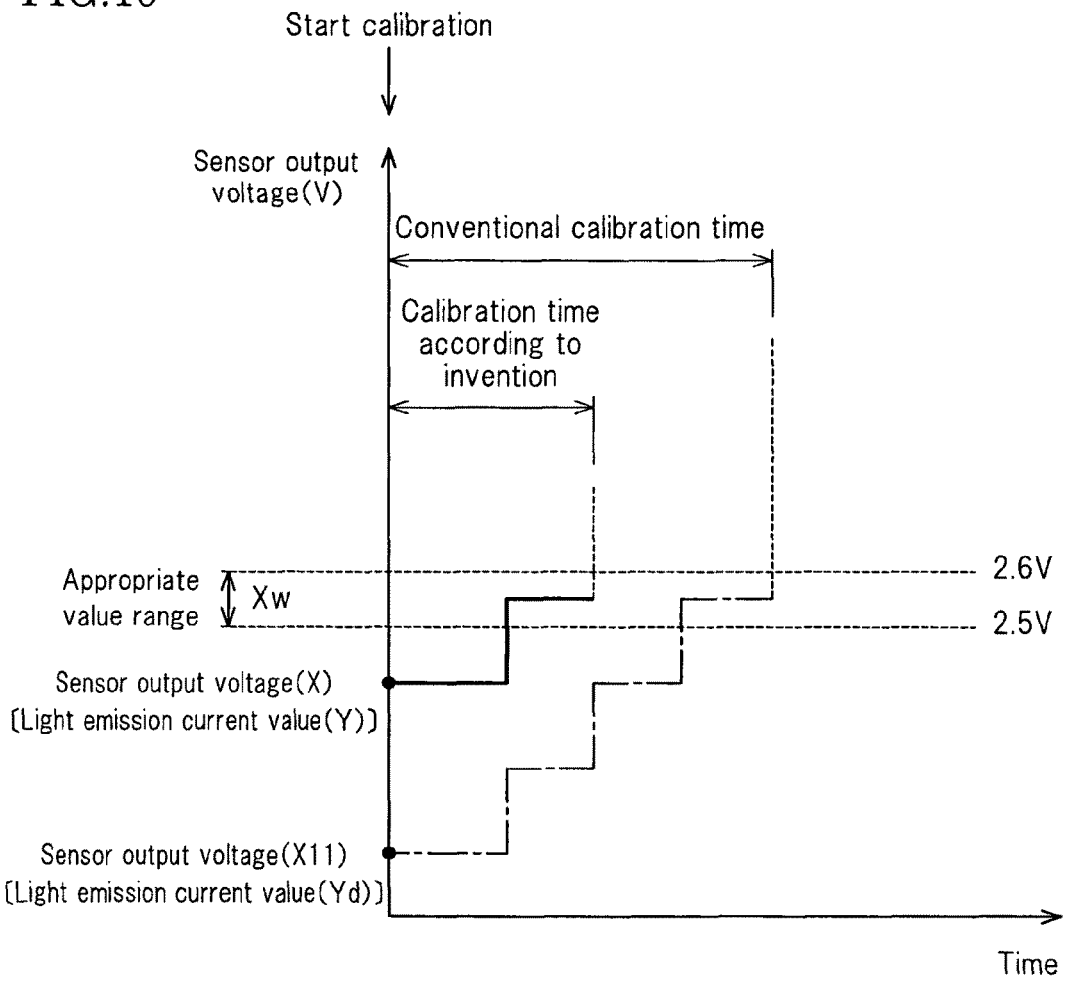
FIG. 10 is an explanatory drawing showing the time required for calibration of an optical sensor in a case where the calibration is performed in the manner according to the present invention (indicated by the solid line) and in a case where the calibration is performed in the conventional manner (indicated by the dashed-dotted line).

More specifically, according to the present invention, since the light emission current value that is selected from the temperature correction table 106*a* for storing a light emission current value corresponding to each temperature in the apparatus is used for initial execution of the calibration, instead of using a default value as in conventional cases, it is possible to obtain the sensor output voltage X that is near the appropriate value range X as indicated by the solid line in FIG. 10. Accordingly, in the example shown in FIG. 10, the sensor output voltage X falls within the appropriate value range Xw after the second iteration of the calibration. That is, in this case, the application of Example 1 of the present invention allows the sensor output voltage X to be modified to fall within the appropriate value range Xw with only two iterations of calibration. On the contrary, in the conventional method using a default value, four iterations of calibration are necessary to modify the sensor output voltage X to fall within the appropriate value range Xw, so the present invention can shorten the calibration time by the amount equivalent to two iterations of calibration.

Also, in Example 1, while the process returns to step S6 if it is determined as No in step S10, the process may return to step S8. That is, the first range of modification (two steps=0.02 (mA)), which is a large range of modification, is used for only the first modification of the light emission current value, and the second range of modification (one step=0.01 (mA)), which is a prescribed range of modification, is used for the second and subsequent modifications of the light emission current value. This use of the second range of modification in the second and subsequent modifications of the light emission current value avoids problems such as that, although the sensor output voltage X of the light receiving device 51*b* is at a level that is almost within the appropriate value range Xw, the light emission current value is modified beyond the appropriate value range Xw due to the use of the first range of modification (a large range of modification) for the next calibration.

Furthermore, in Example 1, while both the first range of modification and the second range of modification are used for the execution of the calibration, it is also possible to use either one of the ranges of modification for calibration. That is, as subsequent processing performed after the case where it is determined as NO in step S5, the processing of steps S6, S7, and S10 or the processing of steps S8, S9, and S10 may be repeated to perform calibration so that the sensor output voltage X falls within the appropriate value range Xw.

EXAMPLE 2

Example 2 shows a case where the drive value is the temperature coefficient value α for the light emission current value Y applied to the light emitting device 51*a* of the optical sensor 51.

Specifically, in Example 2, the light emission current value Y applied to the light emitting device 51*a* is obtained for each execution of the calibration of the optical sensor 51, using Equation 1 as follows:

$$\text{Light emission current value } Y = \text{Previous light emission current value } Y + (\text{Current calibration temperature} - \text{Previous calibration temperature}) \times \text{Temperature coefficient value } \alpha \quad \text{(Equation 1)}$$

That is, the configuration is such that the light emission current value Y applied to the light emitting device 51*a* is obtained by subtracting the temperature in the apparatus (which is stored in a predetermined area of the memory 106) measured by the temperature sensor 52 at the time of execution of previous calibration from the temperature in the apparatus measured by the temperature sensor 52 at the time of execution of current calibration, multiplying the subtraction result (temperature difference) by the temperature coefficient value α, and adding the multiplication result to the light emission current value Y obtained at the time of the execution of the previous calibration and stored in the predetermined area of the memory 106.

Thus, in the configuration of Example 2, as described above, the light emission current value Y at the time of execution of previous calibration, the temperature in the apparatus measured by the temperature sensor 52 at the time of the execution of the previous calibration, and the temperature coefficient value α are stored in a predetermined area of the memory 106. Also in the configuration, the previous light emission current value and the previous temperature in the apparatus are rewritten (updated) for each execution of the calibration of the optical sensor 51. That is, the light emission current value Y and the temperature in the apparatus that have been acquired by the most recent calibration are always stored in a predetermined area of the memory 106.

Moreover, in the configuration of Example 2, the temperature coefficient value α is also recalculated and rewritten (updated) for each execution of the calibration of the optical sensor 51. Updating the temperature coefficient value α as well in this way makes it possible to update the temperature coefficient value individually for each image forming apparatus by performing the calibration of the optical sensor through the actual running of each image forming apparatus, although at the beginning the same temperature coefficient value has been stored for all image forming apparatuses in a lot unit, for example.

Here, the temperature coefficient value α that is initially stored in a predetermined area of the memory 106 is obtained as follows.

Specifically, the light emission current value Y corresponding to each temperature is acquired such that a standard image forming apparatus is manufactured previously with use of a standard optical sensor and a standard intermediate transfer belt and is located under various thermal environments (such as 0° C., 10° C., 20° C., 30° C., 40° C., 50° C., and 60° C.), and the calibration of the optical sensor is performed in the conventional manner, using a default light emission current value. Accordingly, the temperature coefficient value α is obtained by plotting such acquired light emission current values corresponding to temperatures on a graph where the vertical axis represents the temperature and the horizontal axis represents the current value, drawing an approximate straight line (which is obtained by the least squares method, for example) on the plot, and then acquiring the slope of that straight line. The temperature coefficient value α obtained as such is stored as a default value in the predetermined area of the memory 106. That is, the temperature coefficient value α has been obtained in advance by experiments, for example.

In the above description, while the temperature coefficient value α is obtained using a standard image forming apparatus, it is also possible to, for example, extract any one of image forming apparatuses that have been manufactured in a lot unit on the manufacturing line, obtain a temperature coefficient value α by performing experiments as described above with the extracted image forming apparatus, and apply the temperature coefficient value α obtained as a result of the experiments as a temperature coefficient value α for all image forming apparatuses of that lot. In general, unevenness in the performance of various electronic components such as optical sensors often show similar characteristics in the same manufacturing lot unit, so creating a single temperature coefficient value α in a lot unit enables a more appropriate temperature coefficient value to be calculated for each image forming apparatus. Note that the method for acquiring the temperature coefficient value is not limited to the method described above, and if more precision is required for the creation, it is also possible to, for example, obtain an individual temperature coefficient value for each image forming apparatus by experiments as described above.

Figure 11:
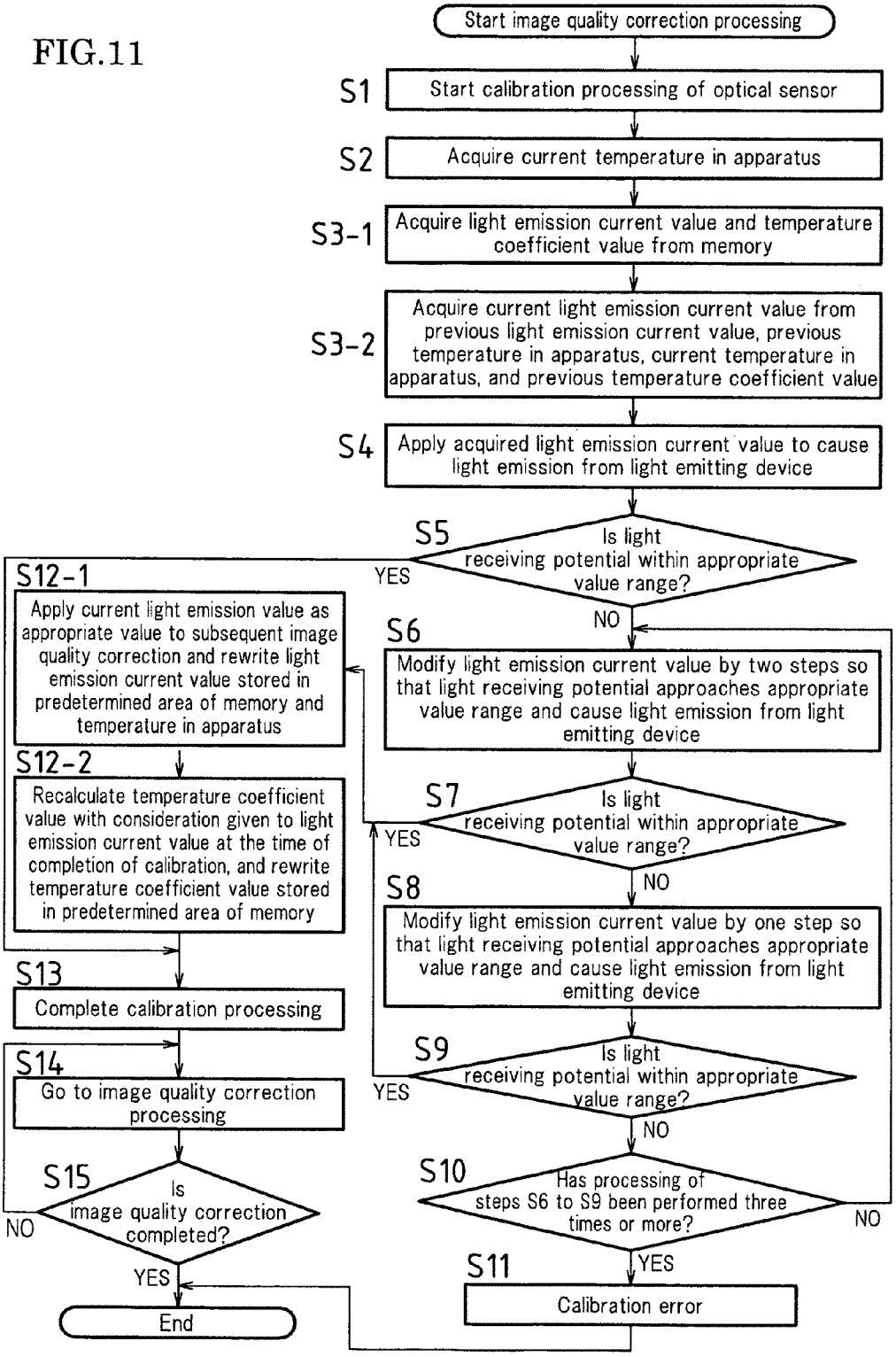
FIG. 11 is a flowchart showing a procedure of calibration processing operations according to Example 2.

FIG. 11 is a flowchart showing a procedure of calibration processing operations according to Example 2. The following description is given regarding the calibration processing operations according to Example 2 with reference to the flowchart of FIG. 11. It is however noted that, since the basic procedure of processing operations is the same as that described in Example 1 with reference to FIG. 9, the same processing operations have been denoted by the same step numbers and have not been described herein, and the description is mainly given regarding what are primarily different from Example 1. The differences of Example 2 are only that step S3 in FIG. 9 is replaced by steps S3-1 and S3-2 and step S12 in FIG. 9 is replaced by steps S12-1 and step S12-2. Focusing on those different parts, the following description is given regarding the procedure of calibration processing operations before and after those parts.

Upon instruction to start image quality correction processing, the control unit 101 starts calibration processing of the optical sensor 51 itself prior to image quality correction processing (step S1).

Specifically, the control unit 101 acquires the current temperature in the apparatus from the temperature sensor 52 (step S2).

Then, the control unit 101 acquires the light emission current value Y and the temperature coefficient value α that have been stored in a predetermined area of the memory 106 (step S3-1). Although default values are used for the light emission current value Y and the temperature coefficient value α before initial calibration is completed after the manufacture of image forming apparatuses, it is assumed herein that the light emission current value, the temperature in the apparatus, and the temperature coefficient value have already been obtained by the previous calibration and stored in the memory 106. Then, the light emission current value Y applied to the light emitting device 51*a* is obtained by subtracting the temperature in the apparatus measured by the temperature sensor 52 at the time of execution of the previous calibration from the temperature in the apparatus measured by the temperature sensor 52 at the time of execution of current calibration, multiplying the subtraction result (temperature difference) by the temperature coefficient value α, and adding the multiplication result to the light emission current value Y obtained at the time of execution of the previous calibration and stored in a predetermined area of the memory 106 (step S3-2).

For example, if the current temperature in the apparatus acquired from the temperature sensor 52 is 30° C., the previous temperature in the apparatus stored in the predetermined area of the memory 106 is 20° C., the previous light emission current value Y is 2.26 (mA), and the temperature coefficient value α is 0.007, the control unit 101 obtains the light emission current value Y for the current calibration by calculation using Equation 2 as follows:

$$\text{Light emission current value } Y = 2.26\ (\text{mA}) + (30^\circ\ \text{C.} - 20^\circ\ \text{C.}) \times 0.007\ (\alpha) = 2.33\ (\text{mA}) \quad \text{(Equation 2)}$$

The control unit 101 applies current to the light emitting device 51*a* of the optical sensor 51 at the obtained light emission current value (Y=2.33 (mA)) and causes light emission from the light emitting device 51*a* (step S4).

The processing of steps S5 to S11 is the same as that of steps S5 to S11 described in Example 1 with reference to FIG. 9, so the description thereof has been omitted herein.

In step S12-1, which is performed when it is determined in step S7 or S9 that the sensor output voltage X is within the appropriate value range Xw, the light emission current value of the light emitting device 51*a* is set so that the light emission current value Y modified in step S6 or S8 is used as an appropriate value (appropriate light emission current value) of the light emitting device 51*a* in subsequent image quality correction processing. The control unit 101 also rewrites the previous light emission current value Y stored in the predetermined area of the memory 106 into the light emission current value Y modified in step S6 or S8, and rewrites the previous temperature in the apparatus stored in the predetermined area of the memory 106 into the current temperature in the apparatus that has been measured.

For example, in a case where the light emission current value Y has been modified from 2.26 (mA) to 2.28 (mA) in step S6, the control unit 101 when going from step S7 to step S12-1 rewrites the light emission current value Y stored in the predetermined area of the memory 106 from the stored value of 2.26 (mA) into 2.28 (mA). The temperature in the apparatus stored in the predetermined area of the memory 106 is also rewritten from the stored value of 20° C. into 30° C., which has been acquired in step S2.

Furthermore, the control unit 101 recalculates the temperature coefficient value α while considering the light emission current value Y at the time of completion of the calibration, and then rewrites the previous temperature coefficient value α stored in the predetermined area of the memory 106 into the calculated temperature correction value α (step S12-2).

Specifically speaking, initial data regarding the light emission current values Y corresponding to respective temperatures that have been acquired under various thermal environments (e.g., 0° C., 10° C., 20° C., 30° C., 40° C., 50° C., and 60° C.) with a standard image forming apparatus is stored in advance in a predetermined area of the memory 106. Then, a light emission current value Y calculated in step S12-2 described above is added to the above data. At this time, if the above data includes the light emission current value Y corresponding to the same temperature as the temperature in the apparatus at which the light emission current value Y has been calculated, the currently calculated light emission current value Y replaces the light emission current value Y at the same temperature. If the temperature is not the same, the currently calculated light emission current value Y is added to the above data as a light emission current value Y at a new temperature.

Thereafter, a new temperature coefficient value α is obtained by plotting the light emission current values Y corresponding to respective temperatures on a graph where the vertical axis represents the temperature and the horizontal axis represents the current value, redrawing an approximate straight line (which is obtained by the least squares method, for example) on the plot, and then obtaining the slope of the redrawn straight line. Then, the previous temperature coefficient value α stored in the predetermined area of the memory 106 is rewritten with the temperature coefficient value α recalculated this time.

For example, if the previous temperature coefficient value α is 0.007 and the temperature coefficient value α recalculated this time is 0.006, the temperature coefficient value α stored in the predetermined area of the memory 106 is rewritten from the stored value of 0.007 to 0.006.

By in this way recalculating and updating the temperature coefficient value α for each execution of calibration, in a case where subsequent calibration is performed using a light emission current value Y that has been calculated using the temperature coefficient value α, the calibration can be started from the light emission current value Y that is closer to (or within) the appropriate value range Xw within which the light emission current value Y is required to fall in order to complete calibration. This further shortens the calibration time. In addition, such updating makes it possible to update the temperature coefficient value α individually for each image forming apparatus by performing the calibration of the optical sensor 51 through the actual running of each image forming apparatus, although at the beginning the same temperature coefficient value α has been stored for all image forming apparatuses in a lot unit, for example.

Thereafter, after the calibration of the optical sensor 51 is completed (step S13), the control unit 101 performs image quality correction processing in the conventional manner, using the optical sensor 51 (step S14).

In Example 2 described above, while the process returns to step S6 if it is determined as No in step S10, the process may return to step S8. In other words, a first range of modification (two steps=0.02 (mA)), which is a large range of modification, may be used for only the first modification of a light emission current value, and a second range of modification (one step=0.01 (mA)), which is a prescribed range of modification, may be used for the second and subsequent modifications of the light emission current value in subsequent calibration. This use of the second range of modification in the second and subsequent modifications of the light emission current value avoids problems, such as that, although the sensor output voltage X of the light receiving device 51*b* is in such a level that is almost within the appropriate value range Xw, the sensor output voltage X of the light receiving device 51*b* is modified beyond the appropriate value range Xw due to the use of the first range of modification (a large range of modification) for the next calibration.

Furthermore, in Example 2, while both the first range of modification and the second range of modification are used for the execution of the calibration, it is also possible to use either one of the ranges of modification for the calibration. That is, as subsequent processing performed when it is determined as NO in step S5, the processing of steps S6, S7, and S10 or the processing of steps S8, S9, and S10 may be repeated to perform calibration so that the sensor output voltage X falls within the appropriate value range Xw.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. An image forming apparatus, comprising a toner image carrier that carries a toner image, a toner image detection sensor that detects a reference toner image on the toner image carrier, a temperature sensor that detects a temperature in the apparatus, and a storage section for storing a correlation between each temperature and a drive value for the toner image detection sensor;

wherein calibration of the toner image detection sensor is performed by acquiring a corresponding drive value from the storage section based on the temperature measured by the temperature sensor and driving the toner image detection sensor at the corresponding drive value, wherein the toner image detection sensor is an optical sensor that includes a light emitting device and a light receiving device, and wherein, when calibrating the toner image detection sensor, the corresponding drive value is acquired from the storage section based on the temperature measured by the temperature sensor, the light emitting device of the toner image detection sensor is driven at the corresponding drive value, and if a detected light received value of the light receiving device is not within a predetermined appropriate value range, a process of modifying the corresponding drive value by a first range of modification so that the detected light received value approaches the predetermined appropriate value range, then again driving the light emitting device, and if the detected light received value of the light receiving device is not within the predetermined appropriate value range, modifying the modified drive value by a second range of modification that is smaller than the first range of modification so that the detected light received value approaches the predetermined appropriate value range and then again driving the light emitting device, is repeated until the detected light received value falls within the predetermined appropriate value range.

2. The image forming apparatus according to claim 1, wherein the toner image carrier includes a transfer belt on which a toner image formed on a photosensitive drum is primarily transferred, and the calibration is performed using a basis material of the transfer belt.

3. The image forming apparatus according to claim 2, wherein the drive value is a current value applied to the toner image detection sensor.

4. The image forming apparatus according to claim 2, wherein the drive value is a temperature coefficient value for a current value applied to the toner image detection sensor, the temperature coefficient value being used for calculation to obtain a current value for driving the toner image detection sensor.

5. The image forming apparatus according to claim 2, wherein a drive value corresponding to the temperature that has been measured by the temperature sensor and stored in the storage section is rewritten into a the drive value for the toner image detection sensor at the completion of the calibration.

6. The image forming apparatus according to claim 1, wherein a shutter is provided between the toner image carrier and the toner image detection sensor, the shutter being provided close to the toner image carrier in a situation where the shutter is closed in order to protect a detection surface of the toner image detection sensor.

7. The image forming apparatus according to claim 6, wherein the shutter is open when executing the calibration.

8. The image forming apparatus according to claim 1, wherein the reference toner image is a pattern for correcting image quality.

9. An image forming apparatus, comprising a toner image carrier that carries a toner image, a toner image detection sensor that detects a reference toner image on the toner image carrier, a temperature sensor that detects a temperature in the apparatus, and a storage section for storing a correlation between each temperature and a drive value for the toner image detection sensor;

wherein calibration of the toner image detection sensor is performed by acquiring a corresponding drive value from the storage section based on the temperature measured by the temperature sensor and driving the toner image detection sensor at the corresponding drive value, wherein, when calibrating the toner image detection sensor, the corresponding drive value is acquired from the storage section based on the temperature measured by the temperature sensor, the light emitting device of the toner image detection sensor is driven at the acquired drive value, and if a detected light received value of the light receiving device is not within a predetermined appropriate value range, a process of modifying the drive value by a first range of modification so that the detected light received value approaches the predetermined appropriate value range and then again driving the light emitting device is repeated until the detected light received value falls within the predetermined appropriate value range, and wherein, when calibrating the toner image detection sensor, the calibration is terminated and an error notification is issued when the detected light received value does not fall within the predetermined appropriate value range even after the number of iterations of calibration has reached a predetermined number of times.

10. A method for calibrating a toner image detection sensor of an image forming apparatus, the image forming apparatus comprising a toner image carrier that carries toner image, the toner image detection sensor that detects a reference toner image on the toner image carrier and includes a light emitting device and a light receiving device, a temperature sensor that detects a temperature in the apparatus, and a storage section for storing a correlation between each temperature and a drive value for the light emitting device of the toner image detection sensor, the method for calibrating the toner image detection sensor comprising:

a first step of acquiring a corresponding drive value from the storage section based on the temperature measured by the temperature sensor;

a second step of driving the light emitting device of the toner image detection sensor at the corresponding drive value;

a third step of, if a detected light received value of the light receiving device is not within a predetermined appropriate value range, modifying the drive value by a first range of modification so that the detected light received value approaches the predetermined appropriate value range;

a fourth step of driving the light emitting device at the drive value acquired by the modification with the first range of modification;

a fifth step of, if the detected light received value of the light receiving device is not within the predetermined appropriate value range, modifying the drive value by a second range of modification that is smaller than the first range of modification so that the detected light received value approaches the predetermined appropriate value range; and a sixth step of driving the light emitting device at the drive value acquired by the modification with the second range of modification;

wherein processing of the third to sixth steps is repeated until the detected light received value falls within the predetermined appropriate value range.

* * * * *